US007654210B2

(12) United States Patent
Sadasue

(10) Patent No.: US 7,654,210 B2
(45) Date of Patent: Feb. 2, 2010

(54) THREADING DEVICE OF SEWING MACHINE

(75) Inventor: Kazuya Sadasue, Tokyo (JP)

(73) Assignee: Juki Corporation, Tokyo (JP)

( * ) Notice: Subject to any disclaimer, the term of this patent is extended or adjusted under 35 U.S.C. 154(b) by 271 days.

(21) Appl. No.: 11/976,586

(22) Filed: Oct. 25, 2007

(65) Prior Publication Data

US 2008/0257241 A1 Oct. 23, 2008

(30) Foreign Application Priority Data

Oct. 26, 2006 (JP) ..... P.2006-291333

(51) Int. Cl.
*D05B 87/00* (2006.01)
*D05B 79/00* (2006.01)
*D05B 81/00* (2006.01)

(52) U.S. Cl. ..... 112/225; 112/302; 362/90

(58) Field of Classification Search ..... 112/225, 112/302, 186, 217.1, 258; 362/89, 90; D15/66, D15/69, 72, 76, 78; 223/99
See application file for complete search history.

(56) References Cited

U.S. PATENT DOCUMENTS 5,001,998 A * 3/1991 Suzuki et al. ..... 112/314
5,113,324 A * 5/1992 Dusch ..... 362/90
6,168,284 B1 * 1/2001 Wacker et al. ..... 362/90
7,314,013 B2 * 1/2008 Fujihara ..... 112/225
2003/0184995 A1 * 10/2003 Seibert et al. ..... 362/90

FOREIGN PATENT DOCUMENTS

JP 8-280965 10/1996
JP 2865470 12/1998
JP 2005329155 A * 12/2005
JP 2007117367 A * 5/2007

* cited by examiner

*Primary Examiner*—Ismael Izaguirre
(74) *Attorney, Agent, or Firm*—Drinker Biddle & Reath LLP

(57) ABSTRACT

A threading device of a sewing machine includes a thread inserting base formed with a thread path hole having a thread inserting port opened toward an outer side of a sewing machine frame, and further formed with an air path hole which joins the thread path hole in the vicinity of the thread inserting port, an air supply device coupled to the air path hole to supply compressed air, and illuminating means provided on the sewing machine frame to irradiate a joining portion of the thread path hole and the air path hole. The thread inserting base includes a transparent member through which at least the joining portion of the thread path hole and the air path hole can be visually recognized.

5 Claims, 5 Drawing Sheets

THREADING DEVICE OF SEWING MACHINE

CROSS-REFERENCE TO RELATED APPLICATION

The present application claims priority from Japanese Patent Application No. 2006-291333 filed on Oct. 26, 2006, the entire content of which is incorporated herein by reference.

TECHNICAL FIELD

The present invention relates to a threading device of a sewing machine which feeds a looper thread toward a looper by utilizing air.

BACKGROUND ART

A threading device of a sewing machine inserts a thread into a thread hole of a looper which forms a seam by cooperating with a needle. In the threading device, there is known a technique in which an opening portion is provided on an outer side of a sewing machine frame, and compressed air is sprayed toward an inner part of a threading tube which is a path for a thread to pass through an inner side of the sewing machine frame, whereby the thread is fed toward the looper (see, e.g., Japanese Patent No. 2865470).

In this threading device, the air is compressed by an air pump interlockingly with a manual operation of a lever (see FIG. 5), and is discharged from a tip of a nozzle attached obliquely to a side surface of the threading tube, whereby the air is supplied toward the inner part of the threading tube.

The nozzle is obliquely attached at a position slightly on a downstream side from the opening portion of the threading tube so that the air is discharged from the tip at a position slightly on an inner side of the threading tube, i.e., the downstream side from the opening portion from which the thread is inserted. When inserting a tip end of the thread supplied from a thread supply source from the opening portion through the threading tube, the tip end of the thread is inserted until it reaches the downstream side of the tip of the nozzle, and the air is discharged by operating the lever, the thread is efficiently fed toward the downstream side of the thread path.

In the field of the sewing machine, moreover, there is known a technique to provide a transparent member on a thread path (see, e.g., JP 8-280965 A).

In the sewing machine disclosed in Japanese Patent No. 2865470, a thread inserting base which supports the threading tube is formed of an opaque member. Therefore, it is difficult for a user to visually check an amount of the thread inserted into a thread inserting port from the outer side of the sewing machine frame. Accordingly, in the event that the amount of the thread inserted into the thread inserting port is insufficient, there is a problem that the compressed air cannot be sprayed directly toward the thread so that the thread cannot be fed smoothly even if the lever for the air pump is operated repetitively. Consequently, there is a problem that the lever is uselessly operated many times, resulting in a decrease in working efficiency.

Even if the technique disclosed in the JP 8-280965 A is utilized to provide a transparent member for the thread path portion so that the thread inserting port is formed of the transparent member, there is a problem that, because threads to be used in the sewing machine are thin and have light colors such as white in many cases, it is difficult to see an inner side of the transparent member, resulting in a deterioration in workability.

SUMMARY

It is an object of the invention to efficiently and easily carry out a threading work for inserting a thread through a looper with a simple structure.

According to a first aspect of the invention, a threading device of a sewing machine includes a thread inserting base formed with a thread path hole having a thread inserting port opened toward an outer side of a sewing machine frame, and further formed with an air path hole which joins the thread path hole in the vicinity of the thread inserting port, an air supply device coupled to the air path hole to supply compressed air, and illuminating means provided on the sewing machine frame to irradiate a joining portion of the thread path hole and the air path hole. The thread inserting base includes a transparent member through which at least the joining portion of the thread path hole and the air path hole can be visually recognized.

According to a second aspect of the invention, a portion of the thread inserting base around the thread inserting port may be formed of a transparent glass material.

According to a third aspect of the invention, the illuminating means may include an LED disposed on an inner side of the sewing machine frame.

According to a fourth aspect of the invention, the air supply device may include an air nozzle coupled to the air path hole, an air generating member coupled to the air nozzle to supply the air by expanding and contracting, and an operating member which expands or contracts the air generating member by being operated.

According to a fifth aspect of the invention, the operating member may be operably disposed on a front side of the sewing machine frame.

According to the first aspect of the invention, the thread inserting base includes the transparent member through which at least the joining portion of the thread path and the air path can be visually recognized from the outside of the sewing machine frame. Therefore, it is possible to easily and visually recognize whether the thread inserted from the thread inserting port is reached to a depth that is sufficient for the thread to be efficiently fed by the air discharged from the air path. Consequently, it is possible to prevent a time-wasting air supplying operation of the air supply device like in the background art in which the operator cannot visually recognize whether the thread is inserted to a sufficient depth from the thread inserting port or not. Thus, the threading work can be carried out easily and efficiently. Moreover, the illuminating means irradiates the joining portion of the thread path and the air path. Thus, it is possible to enhance visibility of the thread inserted from the thread inserting port.

In addition, in a case in where a plurality of thread inserting ports is provided, the thread inserting port into which the thread should be inserted can be shown to an operator by turning on the associated illuminating means. In such a case, the threading work can be carried out more easily.

The thread inserting port is required to have such a strength as to prevent an abrasion or cutting from being caused by a friction of the thread supplied through the thread inserting port. However, according to the second aspect of the invention, because the thread inserting port is formed of a glass material, it is possible to ensure hardness that is sufficient to provide the required strength while enhancing visibility from an outer side. Consequently, it is possible to prevent thread breaking or thread supplying failures from being caused by a worn away portion of the thread inserting port at which a lower thread may be caught. Thus, it is possible to ensure a smooth thread path.

According to the third aspect of the invention, the operator can visually recognize the thread reliably. Thus, the threading work can be carried out easily and reliably.

According to the fourth and fifth aspects of the invention, the threading work can be carried out with a simple structure and a cost can be reduced. Furthermore, it is possible to effectively utilize the inner part of the sewing machine frame which is narrowed by various devices. Thus, it is not necessary to increase a size of the sewing machine frame.

DETAILED DESCRIPTION

Figure 1:
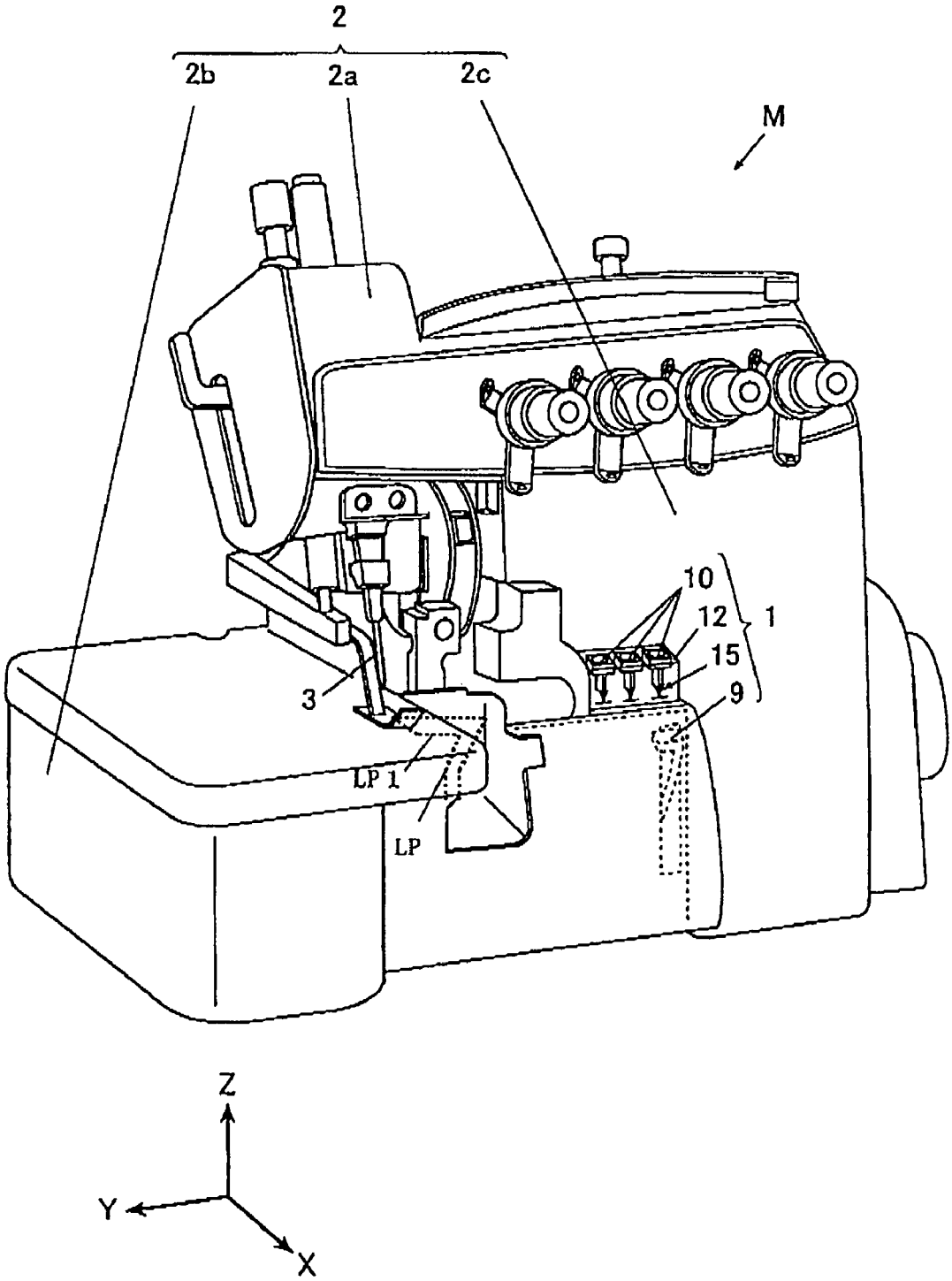
FIG. 1 is a schematic perspective view of a sewing machine according to an exemplary embodiment of the invention.

Hereinafter, exemplary embodiments of the invention will be explained with reference to FIGS. 1 to 4. The following exemplary embodiments and the drawings do not limit the scope of the invention. In the exemplary embodiments, directions of respective portions of a sewing machine M are defined by X, Y and Z axes shown in the drawings. In a state in which the sewing machine M is disposed on a horizontal plane, a Z-axis direction is a vertical direction (an up-and-down direction), a Y-axis direction is a longitudinal direction of an arm portion 2*a* (a right-and-left direction), and an X-axis is a front-and-rear direction which is horizontal and is orthogonal to the Y-axis direction.

(Overall Structure)

FIG. 1 is a schematic perspective view of the sewing machine M having a threading device 1 according to an exemplary embodiment.

Figure 2:
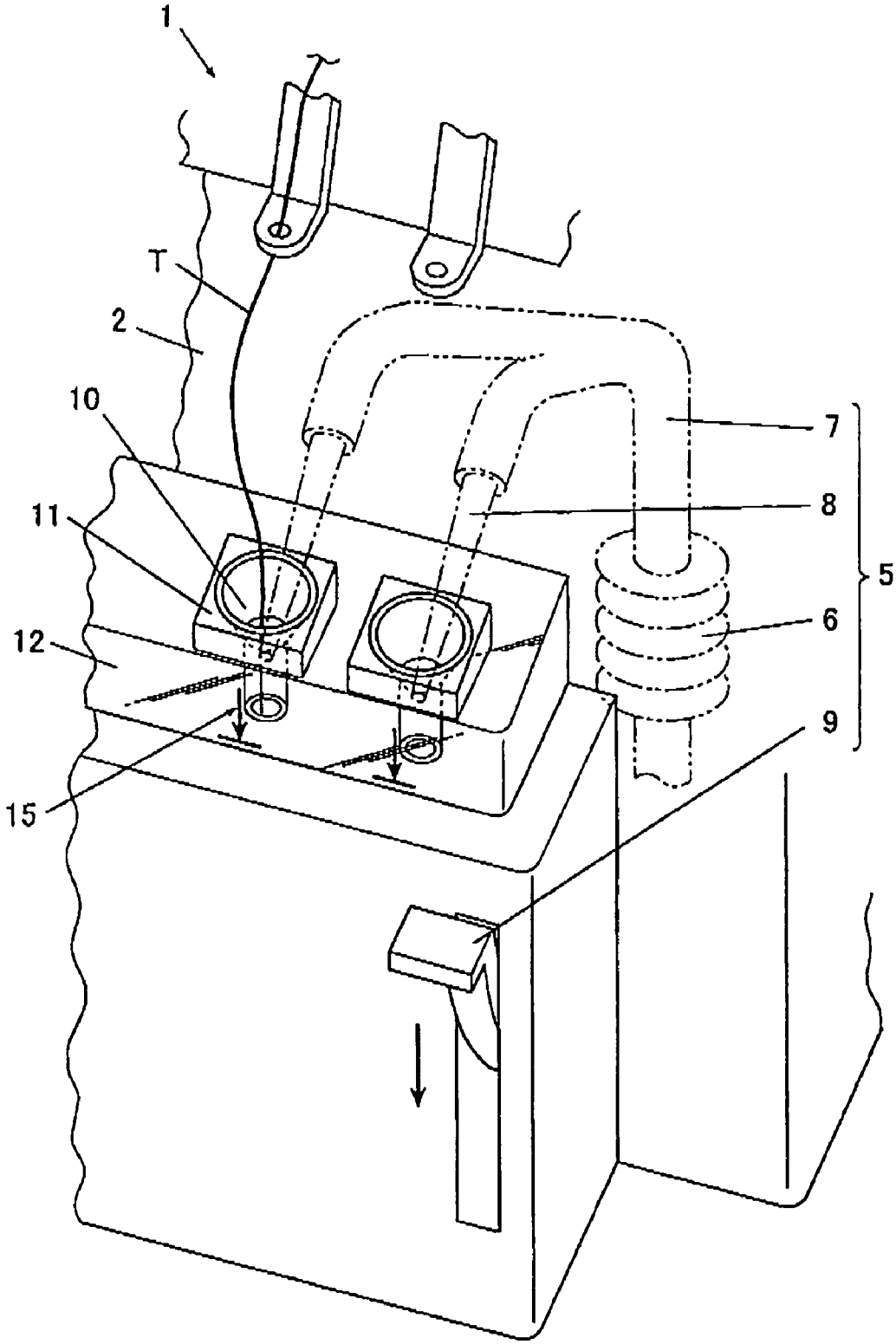
FIG. 2 is a perspective view showing a threading device according to the exemplary embodiment.

As shown in FIGS. 1 and 2, the threading device 1 includes a thread inserting base 12 formed with opening portions 10 opened toward an outer side of a sewing machine frame 2, and an air supply device 5 which supplies compressed air to an air path hole 14 of the thread inserting base 12.

(Sewing Machine Frame)

As shown in FIG. 1, the sewing machine frame 2 includes the arm portion 2*a* which supports a needle 3 so as to be movable in the vertical direction and forms an upper part the sewing machine frame 2, a bed portion 2*b* which is mounted on a sewing machine table (not shown) and forms a lower part of the sewing machine frame 2, and a vertical drum portion 2*c* which couples the arm portion 2*a* and the bed portion 2*b* and is set upright in the vertical direction (the Z-axis direction) orthogonal to the longitudinal direction of the arm portion 2*a* and the bed portion 2*b*. An external shape of the sewing machine frame 2 is a C-shape when seen from a front.

A looper LP is disposed inside the bed portion 2*b* below the needle 3, and forms a seam by cooperating with the needle 3. The looper LP includes an extended portion LP1 which is inserted through a loop of an upper thread formed below a cloth (a workpiece) when the needle 3 penetrating through the cloth is lifted upward. A thread hole (not shown) is formed at a tip portion of the extended portion LP1. A lower thread (a looper thread) T to be entangled with the upper thread to form a seam is inserted through the thread hole of the extended portion LP1. The lower thread T is fed through a predetermined thread path inside the sewing machine frame 2 from the threading device 1, and is inserted through the thread hole.

(Air Supply Device)

The air supply device 5 includes an air pump (an air generating portion) 6 which compresses air with an extensible and hollow bellows portion, an air nozzle 8 having a tip portion 8*a* from which the air supplied from the air pump 6 is discharged, an air supply tube 7 through which the air compressed at the air pump 6 is fed toward the air nozzle 8, and a lever 9 (an operating portion) which is connected to one end of the bellows portion and actuates the air pump 6 when it is manually operated by an operator.

The air pump 6 is disposed inside the vertical drum portion 2*c* of the sewing machine frame 2. The air pump 6 compresses the air when the bellows portion contracts in accordance with the manual operation of the lever 9.

The air nozzle 8 obliquely penetrates a side wall of the thread inserting base 12 toward a downstream side of a thread path hole 13 in such a manner that the lower thread T inserted from the opening portion 10 can be fed toward a side of the looper LP. The tip portion 8*a* of the air nozzle 8 is placed on the same surface as an internal wall of the thread path hole 13 inside the thread inserting base 12 or is at a position slightly retracted therefrom so as not to be protruded into the thread path hole 13 from the internal wall surface.

The lever 9 shown in FIG. 1 includes a tip portion which protrudes from a front surface of the sewing machine frame 2 and movable in the vertical direction, an intermediate portion rotatably supported on the sewing machine frame 2, and a rear end portion which extends toward an inner side of a cover and is coupled to a lower end of the air pump 6. When carrying out a threading operation, the lever 9 is operated with the cover being opened. The lever 9 is pushed downward in a direction of an arrow shown in FIG. 2, and is then returned automatically to an original upper position.

(Thread Inserting Base)

Next, the thread inserting base 12 according to the exemplary embodiment will be described in detail.

Figure 3:
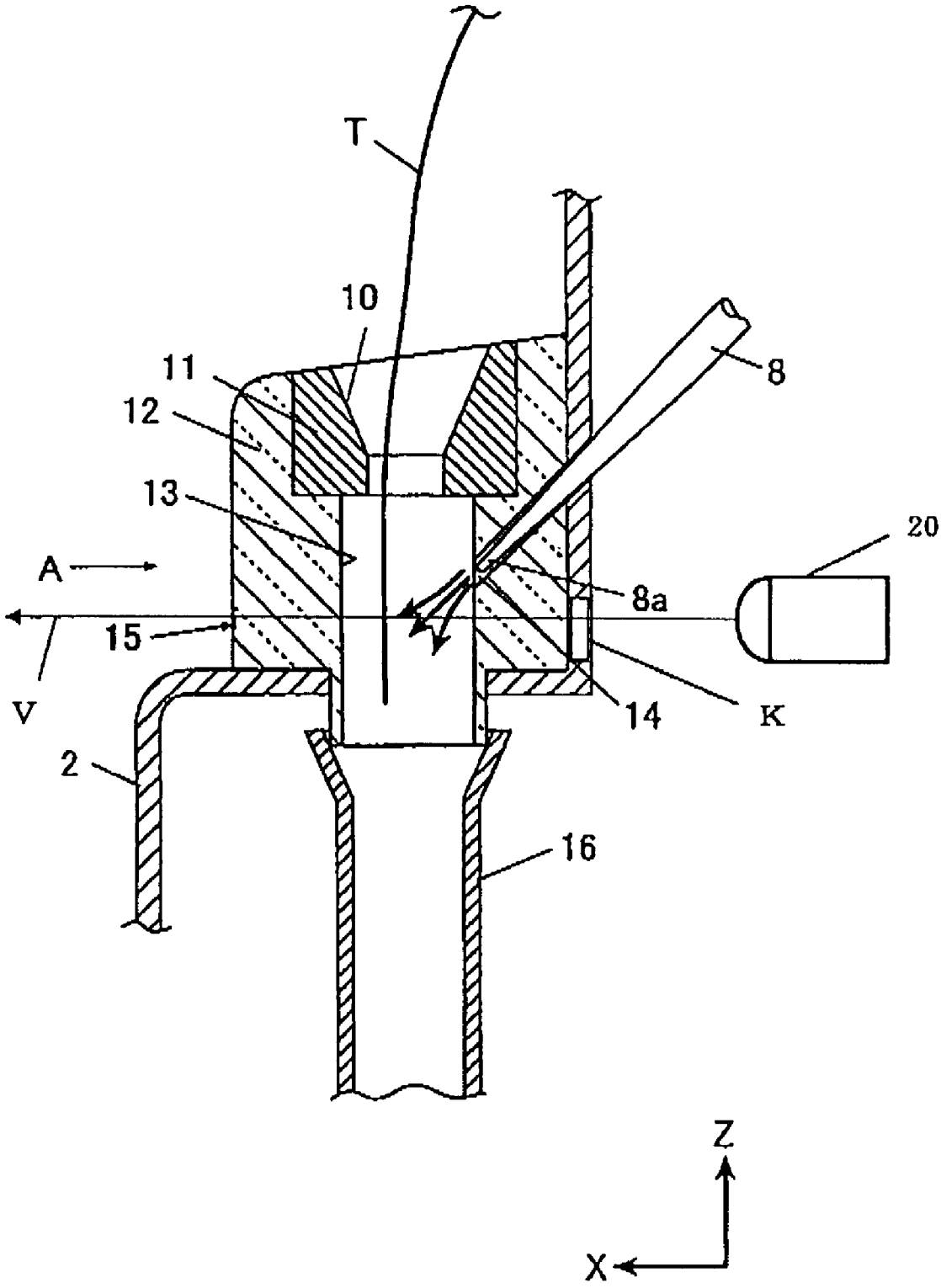
FIG. 3 is a sectional view showing the threading device according to the exemplary embodiment.

As shown in FIGS. 2 and 3, the thread inserting base 12 is formed with the thread path hole 13 having the opening portion 10 which is opened toward the outer side of the sewing machine frame 2 and serves as a port for inserting the thread T, and further formed with the air path hole 14 which joins the thread path hole 13 in the vicinity of the opening portion 10.

The thread path hole 13 penetrates the thread inserting base 12 substantially in the Z-axis direction, and a lower end thereof is coupled to a thread guide tube 16 which leads the thread T to the looper LP. The air path hole 14 is provided toward an inner part of the thread path hole 13 from the inner side of the sewing machine frame 2.

The opening portion 10 is provided with a thread inserting port member 11 which prevents a peripheral edge of the opening portion 10 from being worn away by the lower thread T supplied to the looper LP through the opening portion 10. As shown in FIGS. 2 and 3, an opening of the thread inserting port member 11 is enlarged toward the outer side of the sewing machine frame 2 like a funnel. In order to prevent the wear, the thread inserting port member 11 may be formed of a metal or a ceramic.

The thread inserting base 12 includes a transparent member through which at least the joining portion of the thread path hole 13 and the air path hole 14 can be visually recognized from the outer side of the sewing machine frame 2.

According to the exemplary embodiment shown in FIGS. 1 to 3, the entire body of the thread inserting base 12 is formed of a transparent synthetic resin such as acryl.

The thread inserting base 12 is provided with a indicating portion 15 which indicates an amount the lower thread T to be inserted from the opening portion 10. This indicating portion 15 serves as a reference mark for the operator to visually and easily recognize, from the outer side of the sewing machine frame 2, whether the tip end of the lower thread T is inserted and reached a depth that is sufficient for the lower thread T to be efficiently fed by the air discharged from the tip portion 8*a* of the air nozzle 8. In the exemplary embodiment, the indicating portion 15 is provided at a height on a lower side of the joining portion of the thread path hole 13 and the air path hole 14, i.e., on a downstream side of the joining portion in the path for supplying the lower thread T.

Figure 4:
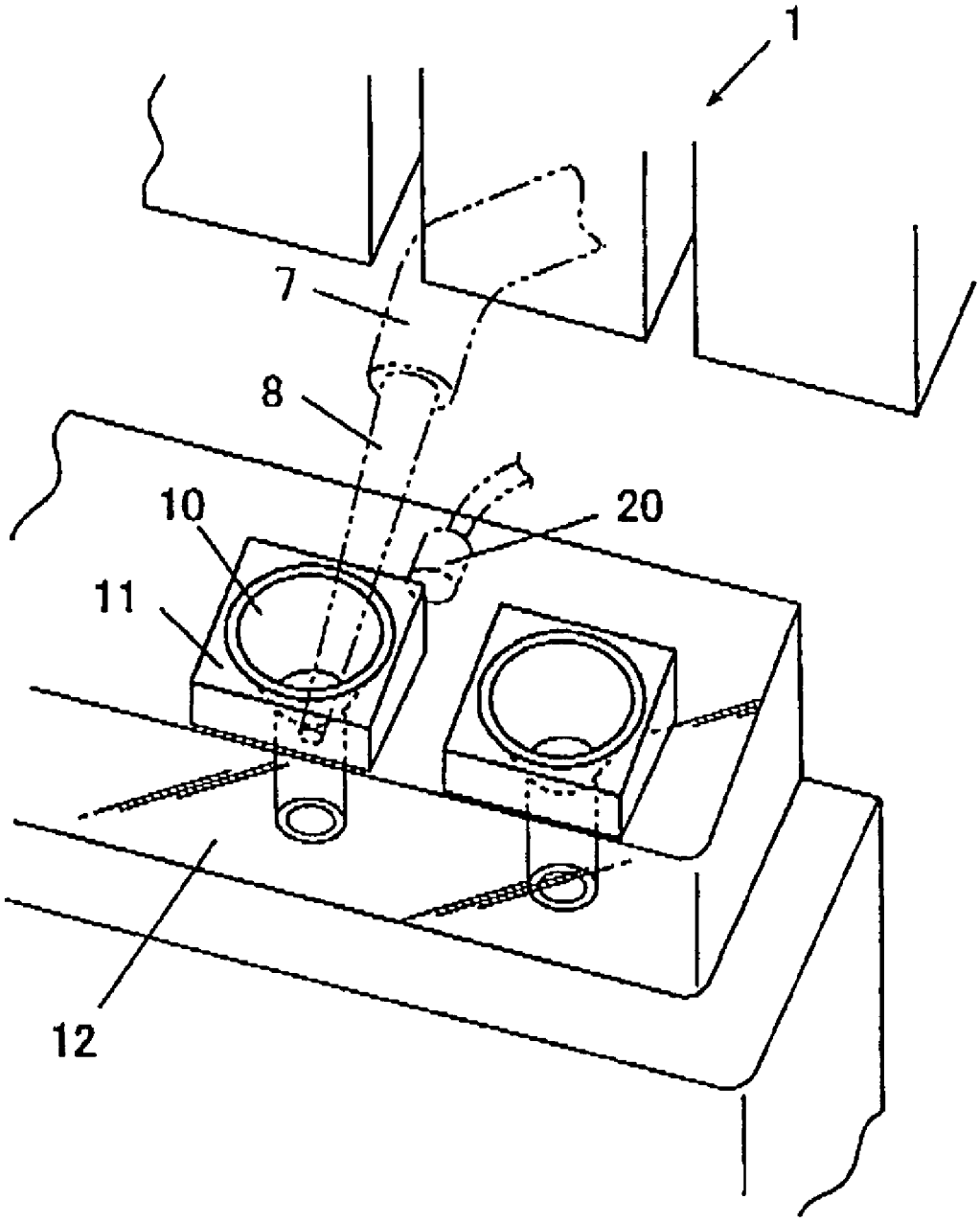
FIG. 4 is a schematic view showing another exemplary embodiment of the invention.
Figure 5:
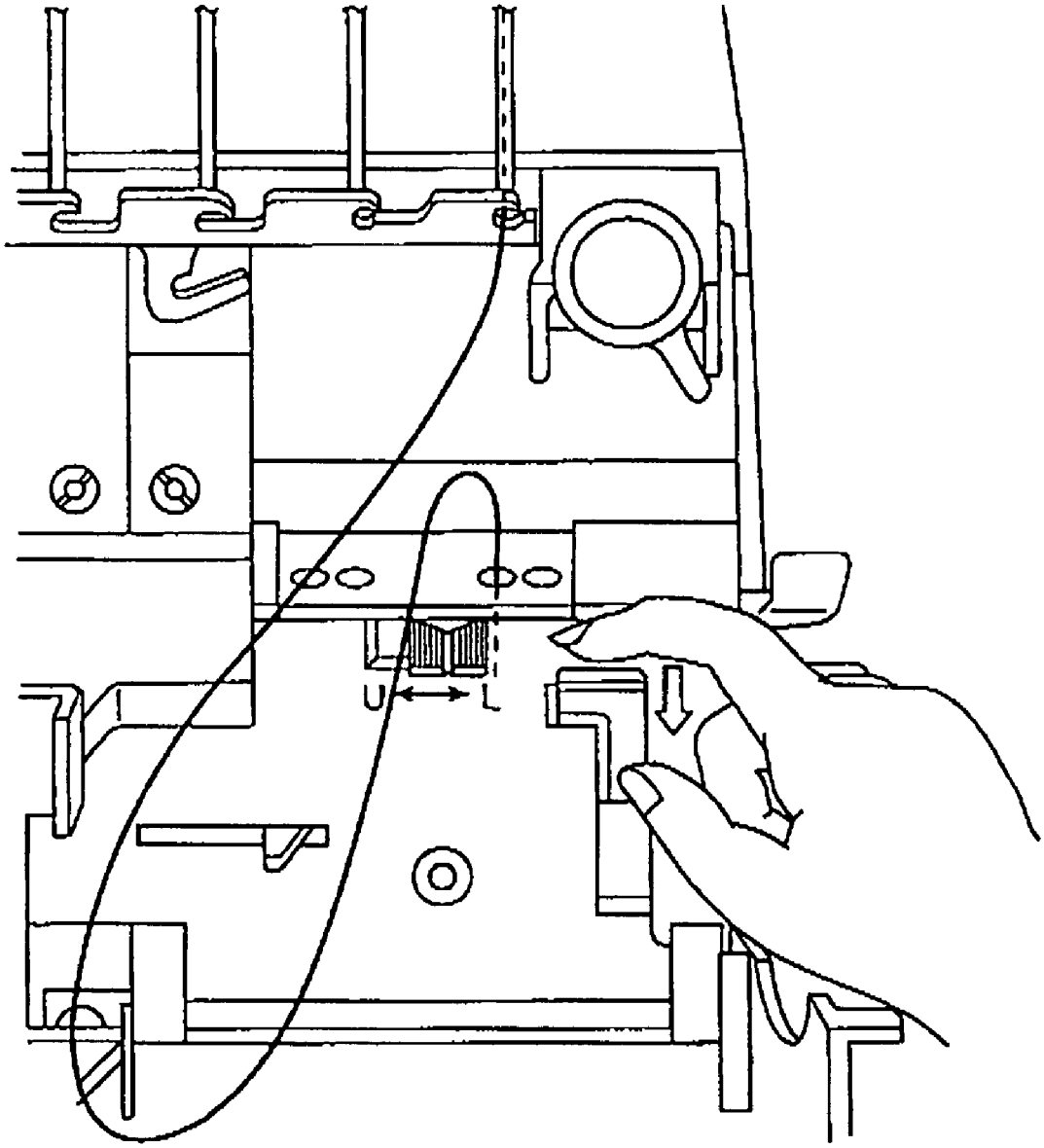
FIG. 5 is a schematic explanatory view showing a threading operation in the background art.

As shown in FIGS. 3 and 4, moreover, an LED (Light Emitting Diode) 20 is fixedly disposed in the sewing machine frame 2 as illuminating means for irradiating light toward the joining portion of the thread path hole 13 and the air path hole 14. An optical axis V of the LED 20 extends from the inner side (a rear side) of the sewing machine frame 2 toward the outer side of the sewing machine frame 2, i.e., the operator side. A transmitting hole K or a transparent member (not shown) which fills the transmitting hole K is provided at a portion of the sewing machine frame 2 where it faces against the irradiated light from LED 20. Accordingly, the LED 20 irradiates the light on the transparent thread inserting base 12 from the rear side, whereby a shadow of the thread in the thread inserting base 12 becomes clear so that the operator can easily see the thread through the thread inserting base 12.

(Explanation of Operation)

Next, description will be given to an operation of the threading device 1 of the sewing machine having the above configuration.

First of all, when inserting the lower thread T for the looper LP from the opening portion 10, the operator inserts the tip end of the lower thread T reeled out from a lower thread supply source (not shown) provided on the outer side of the sewing machine frame 2 into the opening portion 10. At this time, because the thread inserting base 12 is formed as the transparent member (e.g., acryl) and the joining portion is illuminated by the LED 20, the operator can carry out a threading work while visually checking the tip end of the lower thread T inserted from the opening portion 10 form the outer side of the sewing machine frame 2 (see an arrow A in FIG. 3).

After visually recognizing that the tip end of the lower thread T is inserted to the indicating portion 15, the tip portion of the lever 9 is vertically moved so that the air pump 6 coupled to the rear end of the lever 9 actuated to expand and to contract. Consequently, the compressed air is discharged from the tip portion 8*a* of the air nozzle 8, and the lower thread T is fed toward the downstream side of the thread supply path, i.e., toward a side of the looper LP.

As described above, according to the threading device 1 of the sewing machine of the exemplary embodiment, regions on the upstream side and the downstream sides of a portion where the tip portion 8*a* of the air nozzle 8 is placed in the thread supply path are formed of a transparent member. Therefore, it is possible to easily and visually recognize, from the outer side of the sewing machine frame 2, whether the lower thread T inserted through the opening portion 10 is inserted and reached a depth that is sufficient to be efficiently fed by the compressed air discharged from the tip of the air nozzle 8 or not. Thus, time-wasting operations of the air pump 6 can be prevented so that the threading work can be carried out easily and efficiently. Moreover, the indicating portion 15 which indicates the amount the thread to be from the opening portion 10 is provided. Therefore, it is possible to easily decide whether the lower thread T is inserted to a sufficient depth that the lower thread T can be efficiently fed by the air discharged from the tip of the air nozzle 8.

In addition, it is possible to illuminate the joining portion by turning ON the LED 20, and the operator can easily and visually recognize the thread inside the joining portion formed of a transparent member. Specifically, because the light is irradiated toward the operator side (the outer side) from the rear side (the inner side of the sewing machine), it is possible to obtain such an illuminating effect that the thread inserted from the opening portion 10 can be seen more easily. Consequently, the threading work can be carried out easily and reliably.

The thread inserting port member 11 may be formed of a transparent glass material. In this case, the amount of the lower thread T inserted from the opening portion 10 can be visually recognized more clearly from the outer side of the sewing machine frame 2. Moreover, both the thread inserting port member 11 and the thread inserting base 12 may be formed of a glass material so as to be in a one-piece structure.

The illuminating means may be other than LED. e.g., an ordinary lamp, and may irradiate light toward the joining portion from the outer side of the sewing machine frame.

In a case where a plurality of thread inserting ports are provided for supplying the thread to an upper looper and a lower looper, etc., it is possible to provide a guide function which indicates an order of inserting the thread by sequentially turning on lights based on a control signal sent from a control portion (not shown). In this case, it is possible to enhance an operability of the threading work.

In addition, the indicating portion 15 may be provided on an outer surface of the thread inserting base 12 or on an inner part thereof.

While description has been made in connection with exemplary embodiments of the present invention, it will be obvious to those skilled in the art that various changes and modification may be made therein without departing from the present invention. It is aimed, therefore, to cover in the appended claims all such changes and modifications falling within the true spirit and scope of the present invention.

What is claimed is:

1. A threading device of a sewing machine comprising:

a thread inserting base formed with a thread path hole having a thread inserting port opened toward an outer side of a sewing machine frame, and further formed with an air path hole which joins the thread path hole in the vicinity of the thread inserting port, wherein the thread inserting base includes a transparent member through which at least a joining portion of the thread path hole and the air path hole can be visually recognized;

an air supply device coupled to the air path hole to supply compressed air; and illuminating means provided on the sewing machine frame to irradiate the joining portion of the thread path hole and the air path hole.

2. The threading device according to claim 1, wherein a portion of the thread inserting base around the thread inserting port is formed of a transparent glass material.

3. The threading device according to claim 1, wherein the illuminating means includes an LED disposed on an inner side of the sewing machine frame.

4. The threading device according to claim 1, wherein the air supply device comprises:

an air nozzle coupled to the air path hole;

an air generating member coupled to the air nozzle to supply the air by expanding and contracting; and an operating member which expands or contracts the air generating member by being operated.

5. The threading device according to claim 4, wherein the operating member is operably disposed on a front side of the sewing machine frame.

* * * * *